US005334032A

United States Patent [19]

Myers et al.

[11] Patent Number: 5,334,032

[45] Date of Patent: Aug. 2, 1994

[54] ELECTRICAL CONNECTOR

[75] Inventors: Fred D. Myers; Marcus St. E. Cardew, both of Cumbria, United Kingdom

[73] Assignee: Swift 943 Ltd T/A Systems Technologies, Ulverston, United Kingdom

[21] Appl. No.: 60,239

[22] Filed: May 11, 1993

[51] Int. Cl.[5] ..... H01R 13/00

[52] U.S. Cl. ..... 439/140

[58] Field of Search ..... 439/139, 140

[56] References Cited

U.S. PATENT DOCUMENTS

| | | | |
|---|---|---|---|
| 2,444,843 | 7/1948 | Modrey | 439/140 |
| 2,731,611 | 1/1956 | Kamm | 439/140 |
| 3,167,373 | 1/1965 | Kostich | 439/140 |
| 3,491,326 | 1/1970 | Pfister et al. . | |
| 3,508,188 | 4/1970 | Buck . | |
| 3,729,699 | 4/1973 | Briggs et al. | 439/140 |
| 4,109,989 | 8/1978 | Snyder, Jr. et al. | 439/140 |
| 4,142,770 | 3/1979 | Butler, Jr. et al. . | |
| 4,203,640 | 5/1980 | Bice et al. . | |

FOREIGN PATENT DOCUMENTS

| | | |
|---|---|---|
| 1436570 | 5/1976 | United Kingdom . |
| 1561321 | 2/1980 | United Kingdom . |

*Primary Examiner*—Joseph H. McGlynn
*Attorney, Agent, or Firm*—Salter & Michaelson

[57] ABSTRACT

An electrical connector for use in electrically conductive aqueous mixtures, solution or suspensions such as seawater, sewage, electrolytes and so forth has one or more contact pins 3 each having a contact area 4. The contact areas 4 are electrically isolated from the electrically conductive environment by way of a dielectric seal carrier 6 which may be moved away from the contact areas 4 as the socket and the plug of the connector are brought into engagement.

7 Claims, 4 Drawing Sheets

ELECTRICAL CONNECTOR

The present invention relates to an electrical connector.

The present invention has been made from a consideration of the problems associated with the protection of the male conductor pins such as are found in 'male pin/female socket' type electrical connectors, when such connectors are used in hostile conditions such as when they are to be used in electrically conducting environments such as aqueous mixtures, solutions or suspensions, such as seawater, sewage, electrolytes, electrically conducting chemicals or liquids, or liquid metals.

Typically, connectors which may be safely connected or disengaged under water are referred to as 'wet' connectors. Normally, wet connectors have contacts on the 'live' socket that are sealed or protected from exposure to water or moisture. U.S. Pat. Nos. 3,491,326 (F. Pfister et al.) and 3,508,188 (J. R. Buck) disclose examples of disengageable connectors comprising protected female contacts having internal displaceable sealing pistons. US. Pat. No. 3,729,699 (Briggs et al.) also disclose protected female contacts and the use of O-rings to wipe water away from a male pin during engagement.

Generally, when such connectors are disengaged, the male pin conductor areas are left exposed, albeit possibly only for a short period of time, until some form of externally applied protection cap or cover is fitted, and prior to remaking of the connection, any ambient environment fluid or contaminants remaining along the length of the pin have to be physically removed or displaced.

U.S. Pat. No. 4,142,770 discloses protected female contacts, and the use of dense viscous dielectric fluid, controlled by gravity, to protect male pin contacts provided that the plug is vertically mounted face upwards.

Such an arrangement may not be used in any other attitude.

The present invention seeks to provide an inherently self protecting male conductor pin for electrical connectors which remains electrically and environmentally protected at all times and throughout all phases of the engagement and disengagement processes, at any attitude, without the need for any other externally applied protection means.

According to the present invention there is provided an electrical connector for use in electrically conductive environments, said connector comprising at least one contact pin, said contact pin having or being connected to at least one contact area, wherein said contact area is electrically isolated from the electrically conductive environment at least in part by a movable mechanical seal.

This provides a male pin conductor which is electrically isolated from the electrically conductive environment irrespective of mounting attitude.

In a preferred embodiment of the invention the contact pin or array of pins if more than one pin is provided have an insulated tip and preferably an insulated shank. One or more electrical contact areas may be provided along the length of the pin.

The mechanical seal preferably contains a fluid medium sealed from the environment. The fluid is preferably dielectric and is also preferably pressure balanced, for example by sealing the fluid with a flexible member.

The seal is preferably movable from a first position in which the female socket and corresponding male plug are not engaged and the seal or seals are biased to a position in which they enclose the one or more electrical contact area on the pin. The seal is subsequently movable to a second position in which the female socket and male plug are engaged and the seal is moved to a position away from the contacts such that said electrical contacts are in contact with contacts provided on the plug. Throughout the engagement operation contact between the electrical contacts of the pin and the electrically conductive environment is prevented.

As the female socket carrier is engaged upon first contact between the mechanical seal for the pin and the face of the socket carrier, a seal is made between the mechanical seal for the pin and the socket carrier face, causing any ambient environment fluid or contamination to be displaced or absorbed, and thus establishing an initial electrical isolation barrier between the ambient environment fluid and the now enclosed pin and socket, after which the mechanical seal for the pin is progressively displaced axially by reaction against the face of the female socket carrier as the pin enters the female socket, until electrical connection between the male pin contact area and the female socket contact area is achieved.

Upon disengagement of the female socket carrier, the pin protector returns, at all times retaining intimate contact with the disengaging socket carrier by means of its energiser, to the original pin contact enclosing and protecting position.

In a preferred embodiment of the invention, individual seals preferably each with their own biassing means and compensation fluid reservoirs may be employed. Alternatively, in a multi-pin connection application, several pin seals may be mounted within single or multiple carriers and use any combination of individual or common spring energisers and compensation fluid reservoirs. Alternatively a pin seal may be energised by means of positively pressurised dielectric fluid.

The pin seals may comprise single or multiple fluid seals to prevent the egress of compensation fluid to the ambient environment, or to prevent the ingress of liquid or contamination from the ambient environment. Alternatively, combinations of wiping, cleaning or scraping rings may be fitted to work in conjunction with one or more fluid seals.

Alternatively the seals may be arranged with one or more integral dielectric fluid compensation chambers, and an external biassing means whereby at both ends of the pin seal there may be fitted sealing arrangements such that, when energised by landing of the pin seal against an engagement stop position, the sealing arrangements cause any ambient environment fluid or contaminants to be progressively expelled from the seal/engagement stop interface as well as the seal/-socket carrier interface, thus lengthening any possible electrical leakage paths.

The pin seals may be fitted with internal contact areas, arranged to match the pin contact areas, which may be fitted with resistive links to other similarly fitted pin seals within a connector, thus shorting them to together for purposes of potential equalisation or to allow remote measurement and detection of correct operation of the pin seals. Alternatively, such links may be of a capacitive or inductive nature, or may be connected to suitably encapsulated miniaturised electronic equipment or sensors for more comprehensive monitoring or sensing purposes.

In order that the invention may be more readily understood a specific enbodiment thereof will now be described by way of example only with reference to the accompanying drawings in which.

Figure 1:
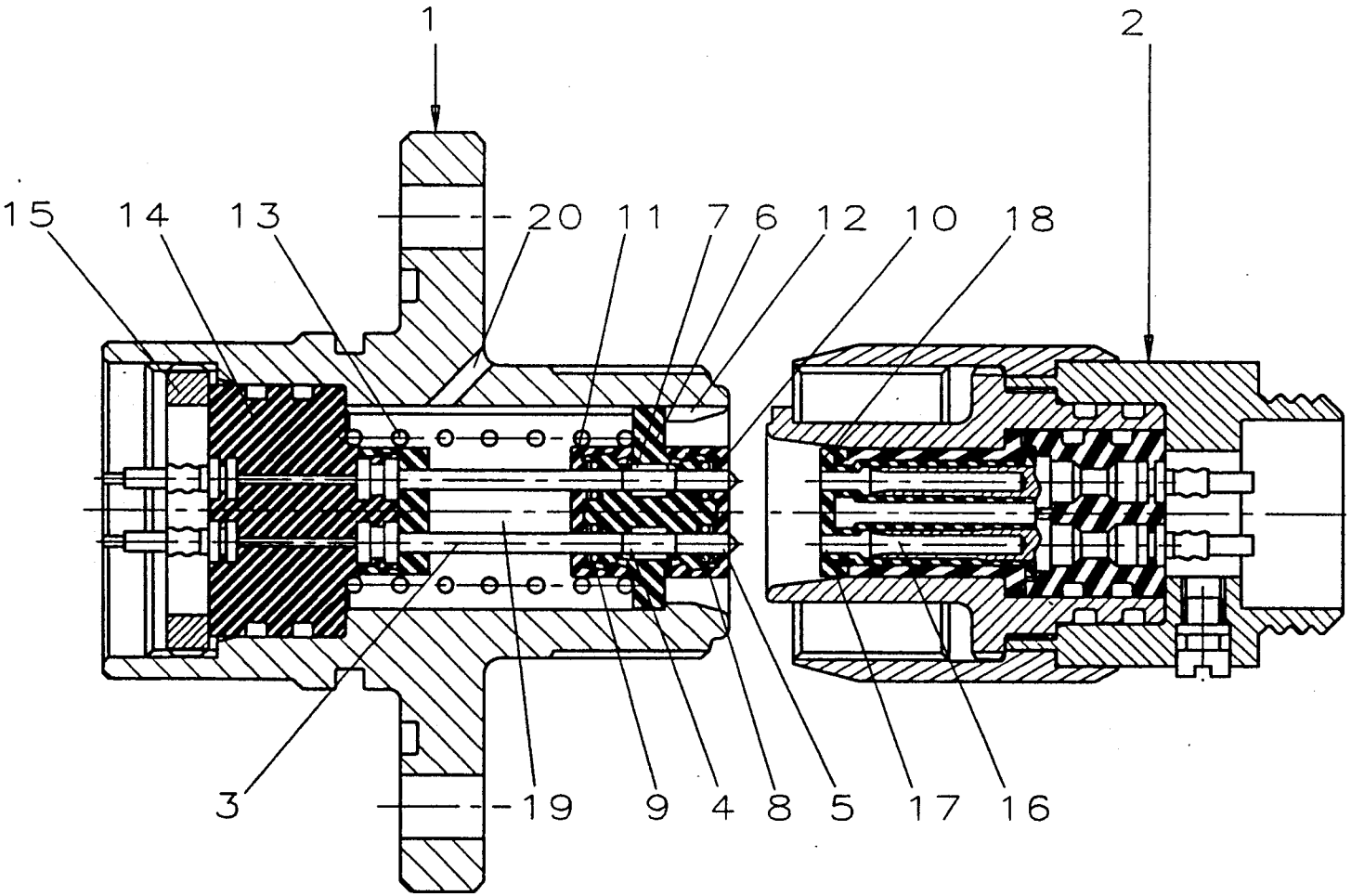
FIG. 1 is a side section showing a disengaged electrical connector in accordance with the invention and a male plug for the connector.

Referring to the drawings a pair of connectors for use in electrically conductive environments comprise a socket housing 1 and a plug housing 2. The socket housing 1 is fitted with insulated connector pins 3, each having an electrical contact area 4 and an insulated tip 5.

A pin seal carrier 6 is constructed of dielectric material and, has two cavities 7, each of which are filled with dielectrical fluid. An annular "O"-ring seal 8 is fitted at the outer end of the cavity and a second identical seal 9 is fitted similarly at the inner end of the cavity. The seals are retained at each end by means of compliant overseals 10,11, at each end of the protector respectively. The seals 8,9 are deliberately allowed to have some axial freedom of movement, such that any changes in volume of the compensation fluid due to temperature or pressure may be accommodated whilst maintaining a pressure balance between the interior and exterior of the pin/socket cavity.

The pin protector is shown in its normal disengaged position which is determined by an annular inner flange 12. The protector is energised to this position by a coil spring 13.

The spring 13 is preloaded by its reaction against the pin protector 6 and the pin carrier 14. The pin carrier is secured in position by a screwed retaining ring 15.

The plug housing 2 has two socket cavities 16, which are accessible through holes 17 in the face of the socket carrier 18.

Figure 2:
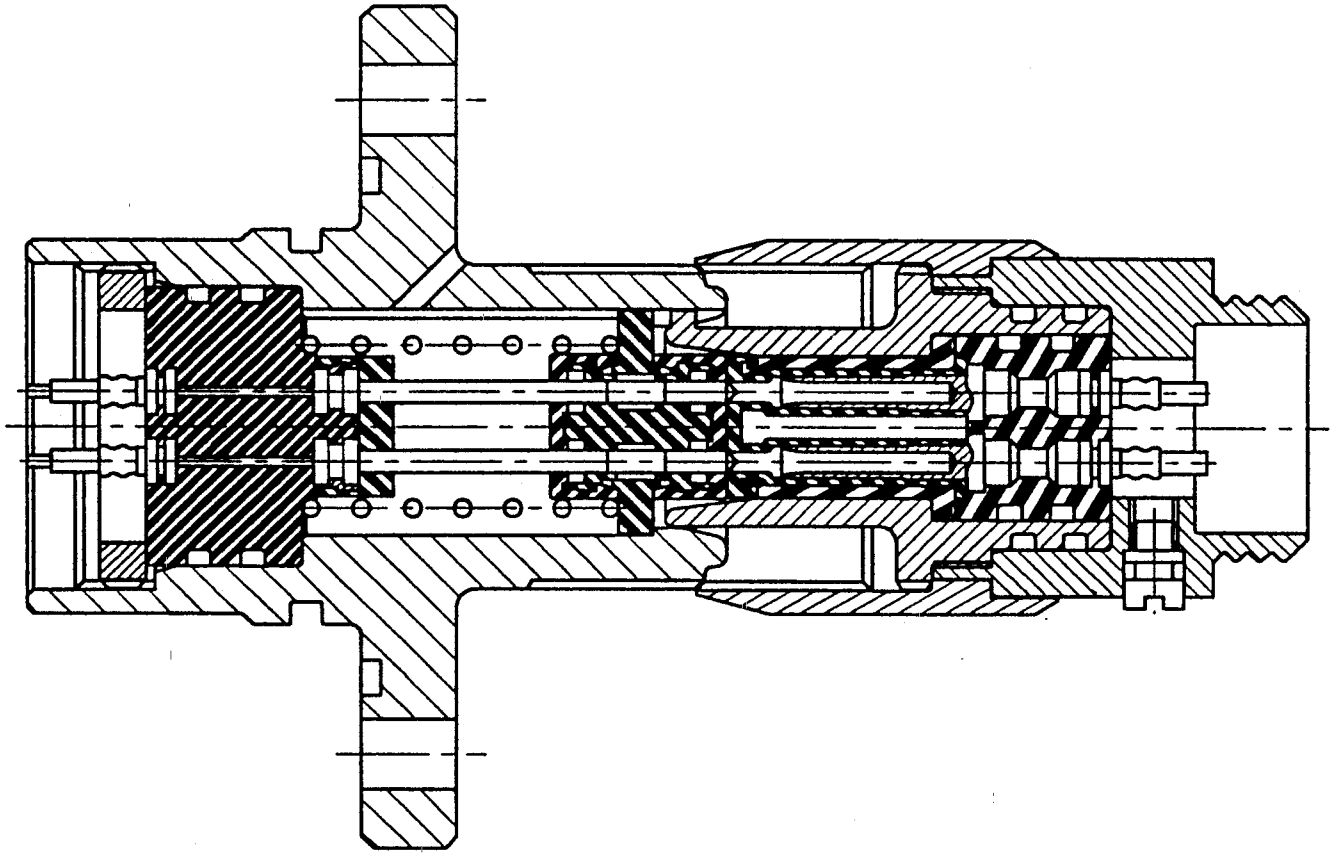
FIG. 2 is a side section showing the initial point of contact of the connector and plug.

FIG. 2 shows the plug and socket at the point of initial contact, where the outer pin protector overseal 10 is being pressed by the socket carrier 18. Due to the compliant nature of one or both of the initial contact elements, and the preload pressure applied to the pin carrier 6 by the energiser spring 13, a squeezing action occurs until the point where the joining force applied the plug and socket overcomes the spring preload pressure, and this squeezing action tends to expel any ambient environment fluid away from the joining face, as well as sealing the internal pin and socket cavities from the external environment. As the plug and socket are progressively engaged any ambient environment fluid that may be trapped within a socket cavity 19 is allowed to escape out to the ambient environment through a vent hole 20.

Figure 3:
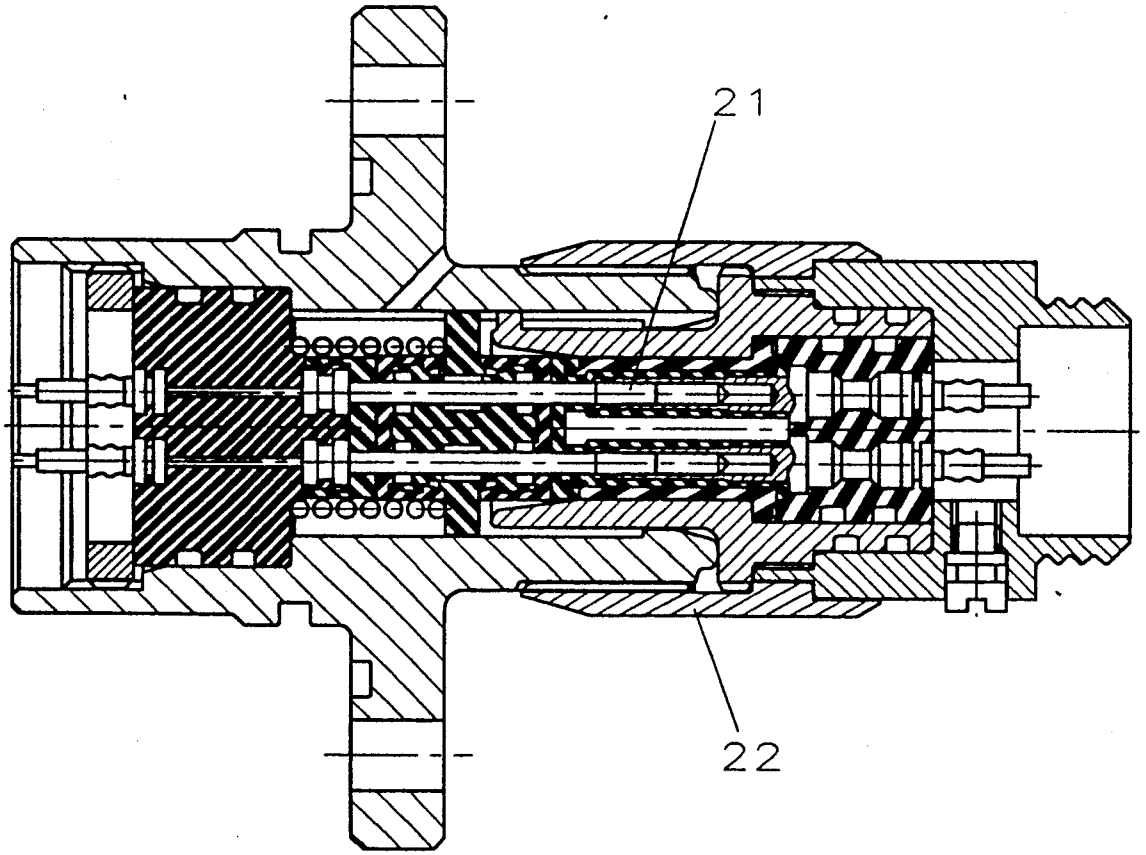
FIG. 3 is a side section showing complete engagement of the connector and plug.
Figure 4:
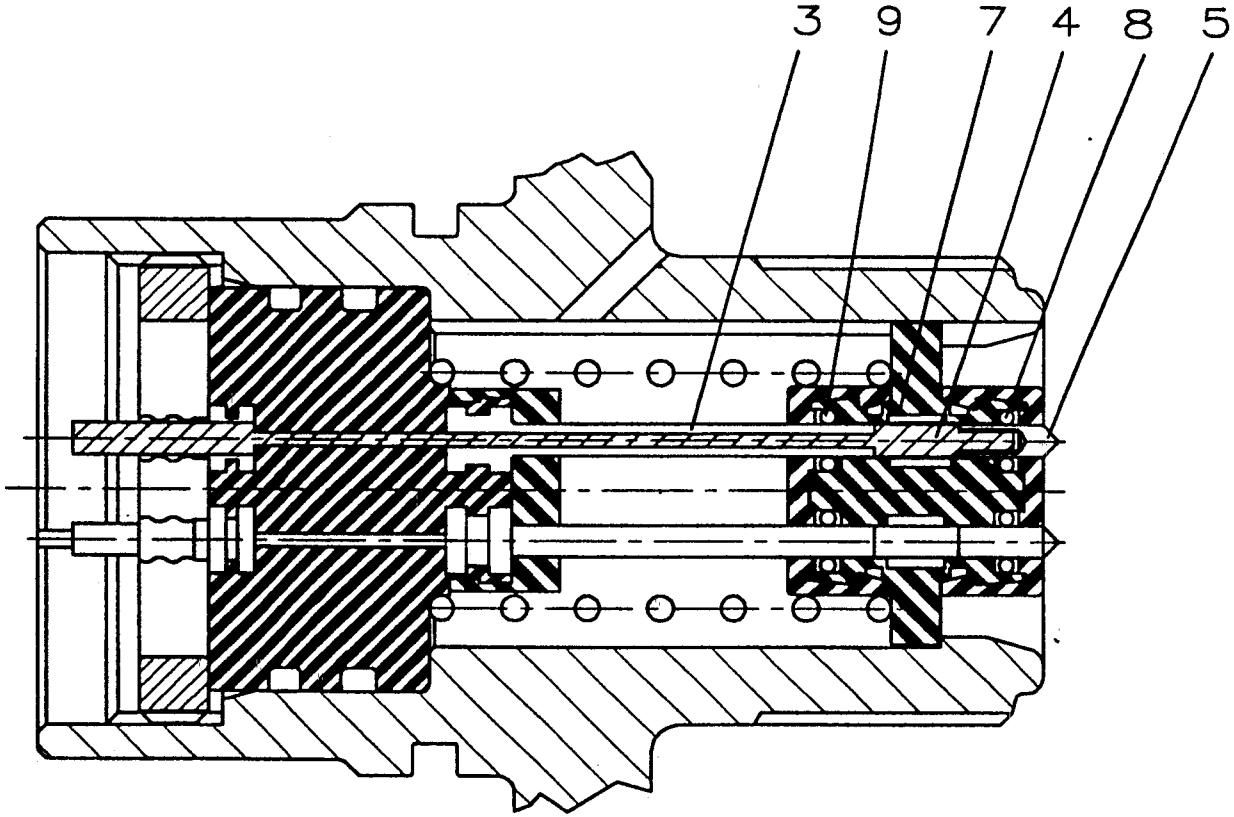
FIG. 4 is an enlarged side section of the electrical connector showing cross-section of the connector pins.

FIG. 3 shows the plug and socket in the fully engaged position with the plug electrical contact mated with a socket electrical contact area 21. The plug and socket is kept closed by means of a screw threaded securing nut 22. When fully engaged, both the pin protector outer overseal 10 to socket face 18 seal and the pin protector inner overseal 11 to pin carrier 14 seal are energised by the force provided by the securing nut 22.

It is to be understood that the above described embodiments have been described by way of illustration only. Many modifications and variations are possible.

For example, the pin seals may be arranged individually or in groups and may have individual or group arrangements for either energisation or fluid compensation. The dielectric compensation fluid cavity may be totally contained within an individual or group of pin seals, or it may be arranged to enclose the volume contained between the pin seals and the pin carrier by means of a flexible diaphragm or shroud or by any sort of variable volume fluid containment arrangement.

We claim:

1. An electrical connector for use in electrically conductive environments, said connector comprising a contact pin, said contact pin having a contact area, wherein said contact area is electrically isolated from the electrically conductive environment by a movable mechanical seal, said mechanical seal containing a fluid medium therein, said mechanical seal including flexible seal members to facilitate pressure balancing of the fluid medium with the electrically conductive environment.

2. An electrical connector as claimed in claim 1, wherein each contact pin has an insulated tip.

3. An electrical contact as claimed in claim 1, wherein each contact pin has an insulated shank.

4. An electrical contact as claimed in claim 1, wherein the fluid is dielectric.

5. An electrical connector as claimed in claim 1, wherein the seal is movable from a first position in which a female socket and corresponding male plug of the connector are not engaged and the seal is biased to a position in which it encloses the electrical contact areas of the connector.

6. An electrical connector as claimed in claim 1, wherein the seal is movable to a position in which the female socket and male plug of the connector are engaged and electrically connected and the seal is moved to a position away from the electrical contact areas of the connector.

7. An electrical connector for use in electrically conductive environments, said connector comprising a housing, a contact pin mounted in said housing a mechanical seal mounted in said housing for movement between a first extended position and a second withdrawn position and means for biasing said mechanical seal to said first position, said contact pin having an insulated tip area and a electrical contact area along a shaft portion thereof, said contact area normally being maintained within said mechanical seal and being electrically isolated from said electrically conductive environment by said mechanical seal when in said first position, said mechanical seal containing a dielectric fluid medium therein which surrounds said contact area of said contact pin, said mechanical seal including flexible seal members to seal said dielectric fluid medium therein and to facilitate pressure balancing of the fluid medium with the electrically conductive environment.

* * * * *